US006781811B2

(12) United States Patent
Posadas

(10) Patent No.: US 6,781,811 B2
(45) Date of Patent: Aug. 24, 2004

(54) IONIZER CONTROL SYSTEM

(75) Inventor: Arnel Posadas, Tokyo (JP)

(73) Assignee: Hugle Electronics Incorporated, Tokyo (JP)

( * ) Notice: Subject to any disclaimer, the term of this patent is extended or adjusted under 35 U.S.C. 154(b) by 67 days.

(21) Appl. No.: 10/246,669

(22) Filed: Sep. 19, 2002

(65) Prior Publication Data

US 2003/0165040 A1 Sep. 4, 2003

(30) Foreign Application Priority Data

Mar. 1, 2002 (JP) ..... 2002-055300
Jun. 20, 2002 (JP) ..... 2002-179873

(51) Int. Cl.[7] ..... H05F 3/00
(52) U.S. Cl. ..... 361/213
(58) Field of Search ..... 361/213, 212

(56) References Cited

U.S. PATENT DOCUMENTS 6,252,233 B1 * 6/2001 Good ..... 250/423 R

* cited by examiner

*Primary Examiner*—Ronald Leja
*Assistant Examiner*—James A Demakis
(74) *Attorney, Agent, or Firm*—Birch, Stewart, Kolasch & Birch, LLP

(57) ABSTRACT

An ionizer control system uses a short-range wireless communication means implemented with, for example, Bluetooth (registered trademark) between an ionizer, an ion monitor, and a server, and that automatically evaluates the performance of the ionizer and the ion monitor, monitors the operational state thereof, and adjusts the ion balance. The ionizer control system includes an ionizer, an ion monitor, and a server, each having communication means that complies with a short-distance wireless communication standard, such as Bluetooth. For example, ionizer control data, including the magnitude and time of a positive or negative voltage applied to emitters, and operational state data are transmitted and received between the server and the ionizer. For example, ion monitor control data, such as a charge start voltage applied to a charge plate and a stop voltage, and operational state data are transmitted and received between the server and the ion monitor.

19 Claims, 7 Drawing Sheets

IONIZER CONTROL SYSTEM

This nonprovisional application claims priority under 35 U.S.C. §119(a) on Patent Application No. 2002-55300 and 2002-179873 filed in Japan on Mar. 1, 2002, and Jun. 20, 2002, which is herein incorporated by reference.

BACKGROUND OF THE INVENTION

1. Field of the Invention

The present invention relates to an ionizer control system for allowing various types of data to be transmitted and received between an ionizer, an ion monitor, and a server for controlling the ionizer and the ion monitor, through the use of a short-distance wireless communication standard, such as Bluetooth (a registered trademark of the Bluetooth SIG, Inc).

2. Description of the Related Art

In the manufacturing processes of semiconductors and liquid crystal devices, in order to prevent elements from being broken or fine particles from adhering thereto due to static electricity, an ionizer is mounted on the ceiling of a clean room, or in a clean booth, a clean tunnel, a manufacturing apparatus, or the like to remove static electricity from an object.

However, with a corona discharge ionizer that causes a corona discharge by applying a high-voltage to the emitters (emitting electrodes) to thereby generate positive or negative ions, the positive/negative ion balance may slightly change depending on an installation environment; thus, the static electricity of an object cannot be efficiently removed in some cases. Consequently, the use of such an ionizer generally requires appropriate adjustment of the ion balance.

Conventionally, a method for adjusting the ion balance, for example, by artificially controlling a positive or negative voltage to be applied to the emitters has been employed. As a result, enormous amounts of time and effort have been required for adjustment operations when a large number of ionizers are installed.

In addition, since a corona discharge ionizer may decrease in performance or may change in ion balance due to age-related deterioration of the emitters, a type of ion monitor called a "charge-plate monitor" is used to periodically measure the density of the positive and negative ions in the vicinity of the surface of an object from which static electricity is to be removed, thereby evaluating the performance of the ionizer or adjusting the magnitude and the time of a voltage to be applied to the emitters. These periodic measurement/adjustment operations, however, have been great burdens on the user.

SUMMARY OF THE INVENTION

The present invention has been made to overcome the above problems, and an object thereof is to provide an ionizer control system that uses a short-range wireless communication means implemented with, for example, Bluetooth (registered trademark) between an ionizer, an ion monitor, and a server, and that automatically evaluates the performance of the ionizer and the ion monitor and monitors the operational state thereof and adjusts the ion balance.

To this end, according to one aspect of the present invention, there is provided an ionizer control system. The ionizer control system includes an ionizer for removing static electricity from an object by generating positive and negative ions through corona discharging, an ion monitor for evaluating the performance of the ionizer, and a server for managing and controlling the ionizer and the ion monitor.

The ionizer, the ion monitor, and the server each include wireless communication means that complies with a short-distance wireless communication standard. The server and the ionizer transmit and receive ionizer control data therebetween via the wireless communication means, and the server and the ion monitor transmit and receive ion-monitor control data therebetween via the wireless communication means.

The communication standard for the wireless communication means is in no way limited to Bluetooth (registered trademark).

In the present invention, the ionizer control data includes the magnitude and the time of a positive or negative voltage applied to the emitters of the ionizer. In addition, when the ion monitor is a charge-plate monitor, the ion-monitor control data may include a charge start voltage and a charge stop voltage.

Preferably, the ion monitor transmits measured data to the server via the wireless communication means, and the server creates the ionizer control data in accordance with the measured data, transmits the ionizer control data to the ionizer via the wireless communication means, and displays the measured data on a display.

Preferably, the ionizer and the ion monitor each transmit operational state data indicating its own operational state to the server via the wireless communication means, and the server displays the operational state data on a display.

The ionizer control system may include a plurality of the ionizers. In this case, of the plurality of ionizers, one ionizer capable of directly communicating with the server via the wireless communication means is set as a master and the other ionizers are set as slaves. The ionizer control data for the slaves and the operational state data of the slaves are transmitted to and received from the server via the master.

According to another aspect of the present invention, there is provided an ionizer control system. The ionizer control system includes an ionizer for removing static electricity from an object by generating positive and negative ions through corona discharging, and an ion monitor for evaluating the performance of the ionizer and managing and controlling the ionizer.

The ionizer and the ion monitor each include wireless communication means that complies with a short-distance wireless communication standard. The ion monitor and the server transmit and receive ionizer control data therebetween via the wireless communication means. The ionizer control data includes data for controlling the magnitude and the time of a positive or negative voltage applied to an emitter of the ionizer.

In this case, preferably, the ionizer transmits operational state data indicating its own operational state to the ion monitor via the wireless communication means, and the ion monitor displays measured data and the operational state data on a display.

The ionizer control system according to the present invention can automatically evaluate the ionizers and the ion monitor, evaluate the operational states thereof, and adjust the ion balance through short-distance wireless communication means. The ionizer control system can eliminate a need for a complicated manual operation for adjusting the ion balance, when, in particular, a great number of ionizers are installed.

DESCRIPTION OF THE PREFERRED EMBODIMENT

The embodiment of the present invention will now be described with reference to the accompanying drawings.

Figure 1:
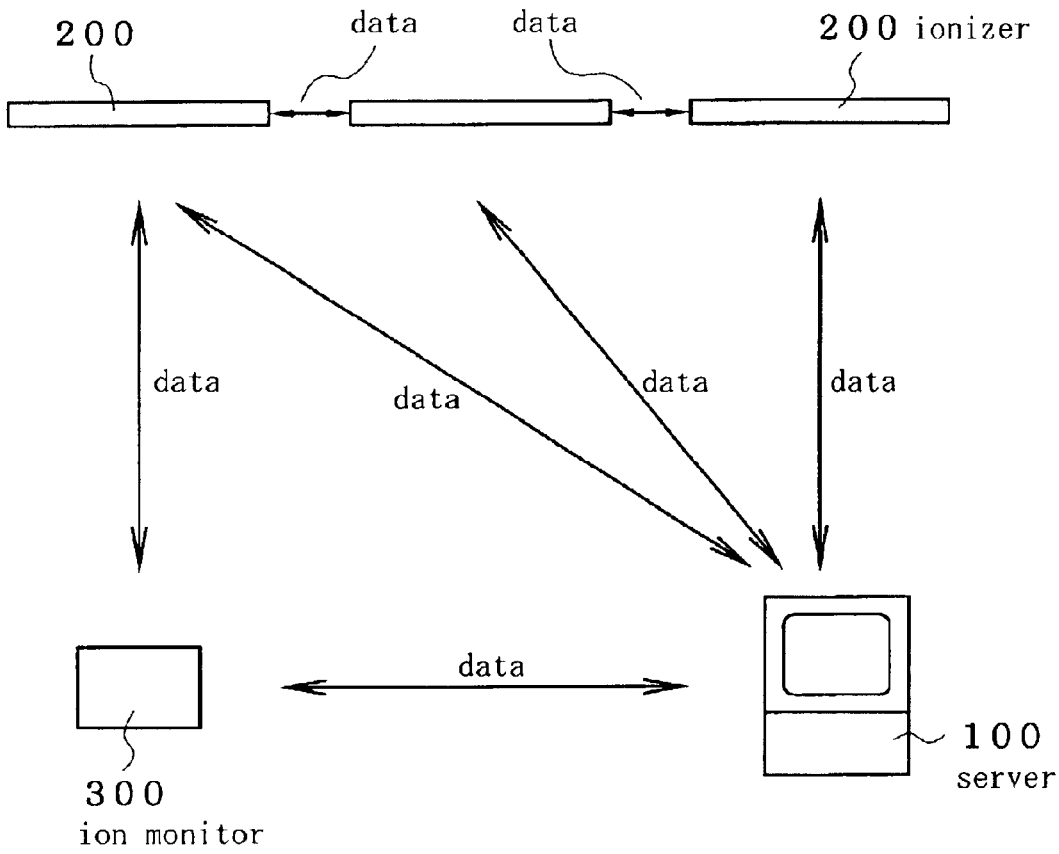
FIG. 1 is a schematic diagram of the overall configuration of an ionizer control system according to an embodiment of the present invention.

FIG. 1 is a schematic diagram showing the overall configuration of an ionizer control system according to an embodiment of the present invention. In FIG. 1, reference numeral 100 indicates a server for controlling and managing the entire system, 200 indicates AC-driven corona discharge ionizers, and 300 indicates an ion monitor. In this case, configuring the system such that the ion monitor 300 directly controls the ionizer 200 can eliminate the use of the server 100. It is to be noted that the present invention is also applicable to a system that controls a plurality of DC-driven ionizers, except for an ion-balance adjusting function.

The server 100, the ionizers 200, and the ion monitor 300 are each provided with wireless communication means, such as a wireless communication module, which is described later, that complies with Bluetooth (registered trademark), and can perform bi-directional communication of various types of data therebetween.

The server 100 is configured with the so-called "personal computer" and has functions of ordinary calculation, memory, control, and display. Through the use of the wireless communication module, the server 100 also has functions of sending, for example, data for controlling the ON/OFF state of the ionizers 200 and the ion monitor 300, data for selecting individual ionizers 200 and the ion monitors 300 in the case of a plurality thereof being provided, and ionizer control data for controlling the polarity, magnitude, and time of a voltage to be applied to the emitters of each ionizer 200. The server 100 further includes functions of receiving operational state data that is individually sent from each ionizer 200 and the ion monitor 300, and measured data, such as the voltage and the amount of ions of a charge plate which are sent from the ion monitor 300. In addition, the server 100 has a function of displaying the operational state data, measured data, static-decay time, and the like.

In the illustrated embodiment, each ionizer 200 may be an ionizer bar that is mounted on the ceiling of a clean room. The present invention, however, does not restrict the ionizer 200 to the ceiling-mounted type ionizer bar, and may also be applied to a desktop-mounted type ionizer.

The ionizers 200 have basic functions of creating a positive or negative high-voltage by themselves using a low-voltage of alternating- or direct-current, applying the high voltage to a large number of emitters such that air around the emitters is charged with positive/negative ions by corona discharging, and supplying the generated positive/negative ions to an object, from which static electricity is removed, in air currents. In addition, each ionizer 200 uses an internal wireless communication module to provide functions of, for example, transmitting its own operational state to the server 100 and the ion monitor 300, receiving the ionizer control data transmitted from the server 100 and the ion monitor 300, and transmitting and receiving the ionizer control data to and from another ionizer 200.

The ion monitor 300 includes a charge-plate monitor and an ion-measuring monitor. The charge-plate monitor is used to measure static-decay time and a voltage on a charge plate when the ionizer 200 is operated with the charge plate being pre-charged with a positive or negative high-voltage, thereby evaluating the performance of the ionizer 200 or measuring the ion balance. The ion-measuring monitor is used to measure the amount of ions on a measurement plate when the ionizer 200 is operated. The ion monitor 300 may also have a function of displaying the measured data.

In addition, the ion monitor 300 uses an internal wireless communication module to provide functions of, for example, transmitting the measured data to the server 100, creating ionizer control data according to one's need, and transmitting the ionizer control data to the ionizer 200.

The server 100, the ionizers 200, and the ion monitor 300 are arranged such that the maximum communication distance from one of the above to another is about 10 meters.

The configuration of each ionizer 200 will now be described with reference to FIGS. 2 and 3.

Figure 2:
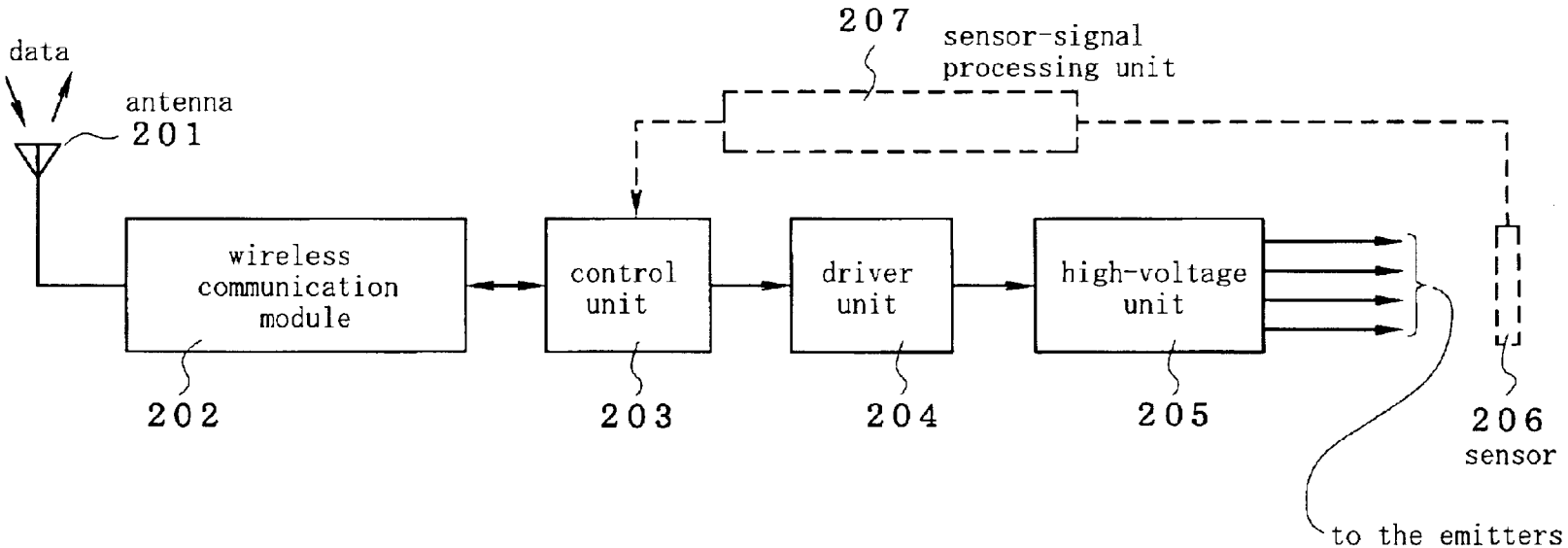
FIG. 2 is a block diagram showing a major portion of an ionizer according to the embodiment of the present invention.

FIG. 2 is a block diagram showing a major portion of each ionizer 200. A wireless communication module 202, which complies with Bluetooth (registered trademark), is provided and is connected to an antenna 201, such as a chip antenna.

The wireless communication module 202 allows the ionizer 200 to perform bi-directional wireless communication of various types of data, such as the ionizer control data and the operational state data of the ionizer 200, with the server 100, the ion monitor 300, or another ionizer 200. The wireless communication module 202 includes a MODEM employing a frequency hopping system, a baseband processing circuit, a transmitting/receiving amplifier, and the like, and performs short-distance wireless communication of various types of data through the use of, for example, a 2.4-GHz band radio-wave.

A control unit 203 is connected to the wireless communication module 202. The control unit 203 sends a control signal to a driver unit 204 at a subsequent stage, so as to control the magnitude and time of a positive or negative voltage applied to the emitters in accordance with the ionizer control data sent from the wireless communication module 202. The control unit 203 also has a configuration, which is described later and is shown in FIG. 3, such that it monitors the operational state of itself and sends the operational state data to the wireless communication module 202, which in turn transmits the data to the server 100 and the like.

A sensor 206 and a sensor-signal processing unit 207, which are indicated by the broken lines, are optional parts for use in a self-control mode in which the ionizer 200 is independently operated to adjust the ion balance by itself, and thus is not an integral element of the present invention.

The driver unit 204 sends a control signal for driving a high-voltage unit 205 that generates a positive or negative high-voltage to be applied to the emitters, in accordance with the ionizer control data sent from the control unit 203.

The high-voltage unit 205 generates a positive or negative high-voltage from a low-voltage of alternating or direct current in accordance with the control signal sent from the driver unit 204, and applies the high voltage to the emitters via a relay contact.

Figure 3:
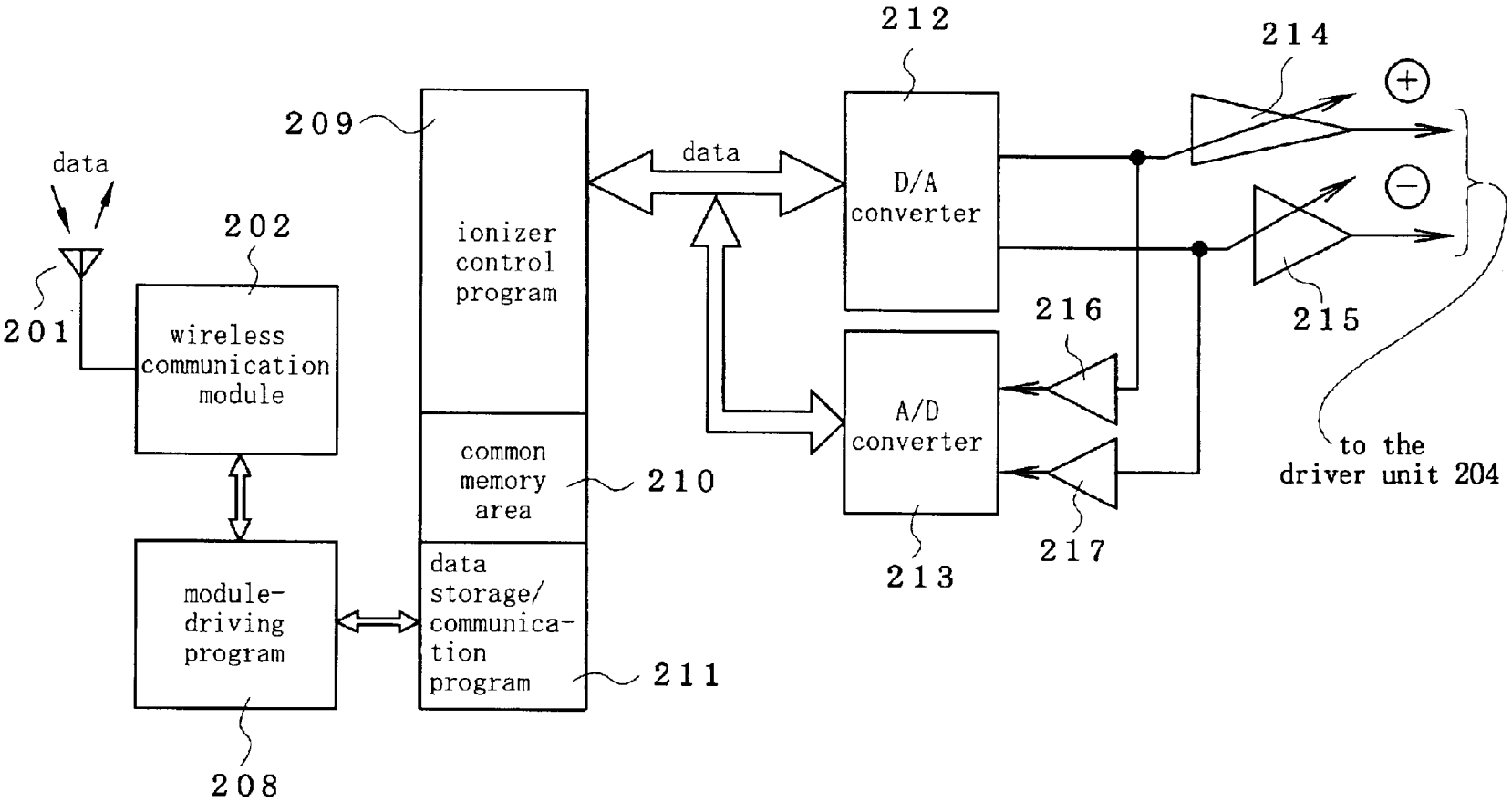
FIG. 3 is a block diagram of a major portion of the configuration shown in FIG. 2.

FIG. 3 shows a major portion of the configuration shown in FIG. 2. The configuration in FIG. 3 corresponds to the internal configurations of the wireless communication module 202 and the control unit 203 shown in FIG. 2.

Referring to FIG. 3, a module-driving program 208 is used to drive the wireless communication module 202 and cooperates with a data storage/communication program 211 to allow the wireless communication module 202 to execute transmission and reception of various types of data.

Meanwhile, an ionizer control program 209 is used to generate control data, which is to be sent to the driver unit 204, for applying a voltage having a predetermined polarity and magnitude to the emitters for a predetermined period of time in accordance with the ionizer control data received by the wireless communication module 202. The ionizer control program 209 is also used to obtain data indicating the operational state of the corresponding ionizer 200 and to transmit the data to the server 100 and the ion monitor 300 via the wireless communication module 202.

The data storage/communication program 211 activates the module-driving program 208 and the ionizer control program 209, and also performs processing for storing the ionizer control data and the operational state data in a common memory area 210. The common memory area 210 can be accessed from both the ionizer control program 209 and the data storage/communication program 211.

The control data, created by the ionizer control program 209, for the driver unit 204 is converted into analog data by a digital-to-analog (D/A) converter 212. The analog data is then sent to the driver unit 204 via an amplifier 214 for applying a positive voltage to the emitters and an amplifier 215 for applying a negative voltage to the emitters.

In addition, data to be input to the amplifiers 214 and 215 is also input to an analog-to-digital (A/D) converter 213 via amplifiers 216 and 217. The data input to the A/D converter 213 is converted into digital data and is stored in the common memory area 210 in accordance with the ionizer control program 209. The data that is stored in the common memory area 210 via the A/D converter 213 serves as operational state data that indicates whether or not the major portion of the ionizer 200 is in a normal operation state. The operational state data can be transmitted from the wireless communication module 202 to the server 100.

Next, the configuration of the ion monitor 300 will be described with reference to FIGS. 4 and 5, in which a charge-plate monitor is illustrated as the ion monitor 300 by way of example.

Figure 4:
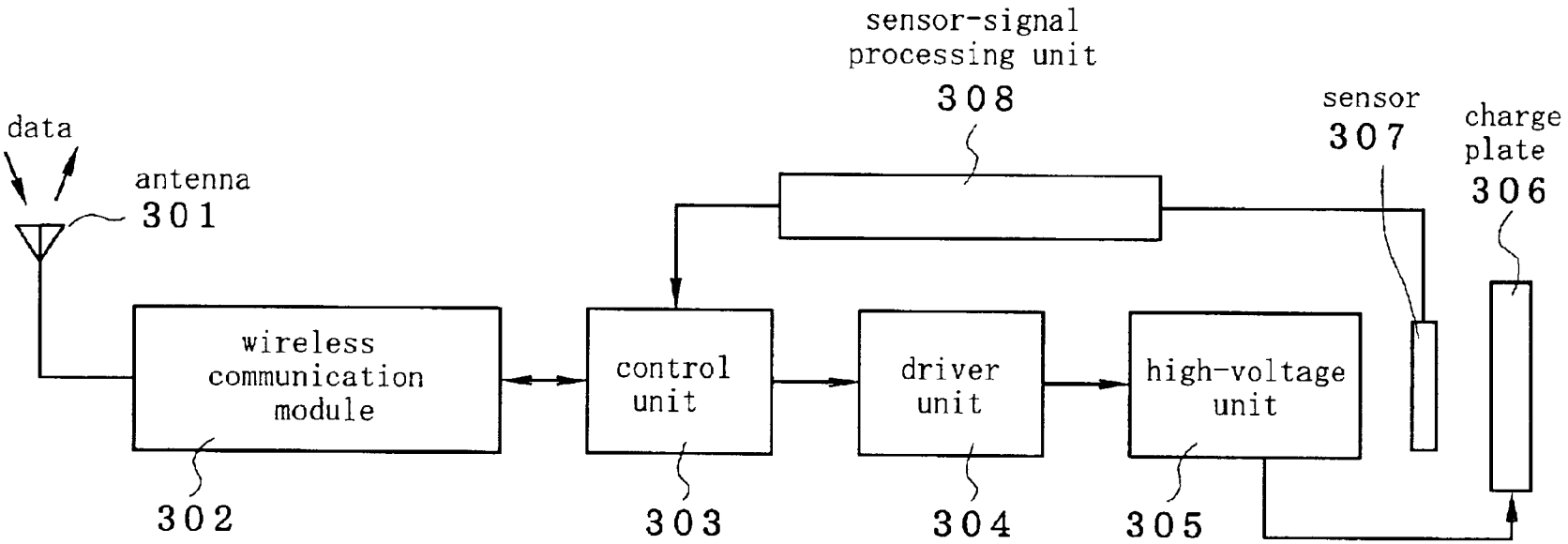
FIG. 4 is a block diagram showing a major portion of an ion monitor according to the embodiment of the present invention.

FIG. 4 is a block diagram showing a major portion of the ion monitor 300. The configuration and functions of a wireless communication module 302 are similar to those of the wireless communication module 202 in the ionizer 200, but is different in that the wireless communication module 302 shown in FIG. 4 transmits and receives various types of data to and from the server 100 and ionizer 200.

Data communicated between the ion monitor 300 and the server 100 includes measured data of the voltage and the amount of ions of a charge plate, data for controlling the ON/OFF state of the ion monitor 300, a charge starting command, operational state data, identification code data, operational condition data (including a start voltage applied to a charge plate 306 of the ion monitor during measurement, stop voltage, and offset voltage) of the monitor 300.

Data communicated between the ion monitor 300 and each ionizer 200 includes ionizer control data for instructing a voltage to be applied to the emitters when the ion balance of the ionizer 200 is out of balance during initialization, and the identification code data of each ionizer 200. The data may also include the operational state data of the ionizer 200 and the ionizer control data, when, including the time of initialization, the ion monitor 300 directly controls the ionizer 200.

In accordance with, for example, the operational condition data transmitted from the server 100 via the wireless communication module 302, a control unit 303 shown in FIG. 4 sends control data to a driver unit 304, for applying a positive or negative start voltage (e.g., ±1,000 V) to the charge plate 306. In accordance with the control data, the driver unit 304 drives a high-voltage unit 305 to apply a predetermined high voltage to the charge plate 306 via a relay contact, thereby causing the charge plate 306 to become charged.

Meanwhile, in response to a command from the server 100, the ionizer 200 is operated and a non-contact sensor 307 measures the voltage of the charge plate 306. The measured data is amplified by a sensor-signal processing unit 308 and is input to the control unit 303.

The control unit 303 sequentially stores the measured data.

When the ion monitor 300 is an ion-measuring monitor, ion current flowing through a plate is directly measured by a sensor, and the resulting data is input to the control unit 303 and is stored as measured data of the amount of ions.

The measured data is transmitted to the server 100 via the wireless communication module 302.

Upon receiving the measured data, the server 100 measures time when the voltage of the charge plate changes from a start voltage down to a stop voltage to determine static-decay time, and evaluates the performance of the ionizer 200 based on the static-decay time. In addition, the server 100 determines the positive/negative ion balance, and if it is out of balance, the server 100 calculates a positive or negative voltage so as to keep the ions in balance and sends the calculated voltage, as the ionizer control data, from the internal wireless communication module to the ionizer 200.

Thereafter, the ionizer 200 applies a predetermined voltage to the emitters, by using the configuration shown in FIGS. 2 and 3, so as to keep the positive/negative ion balance.

Figure 5:
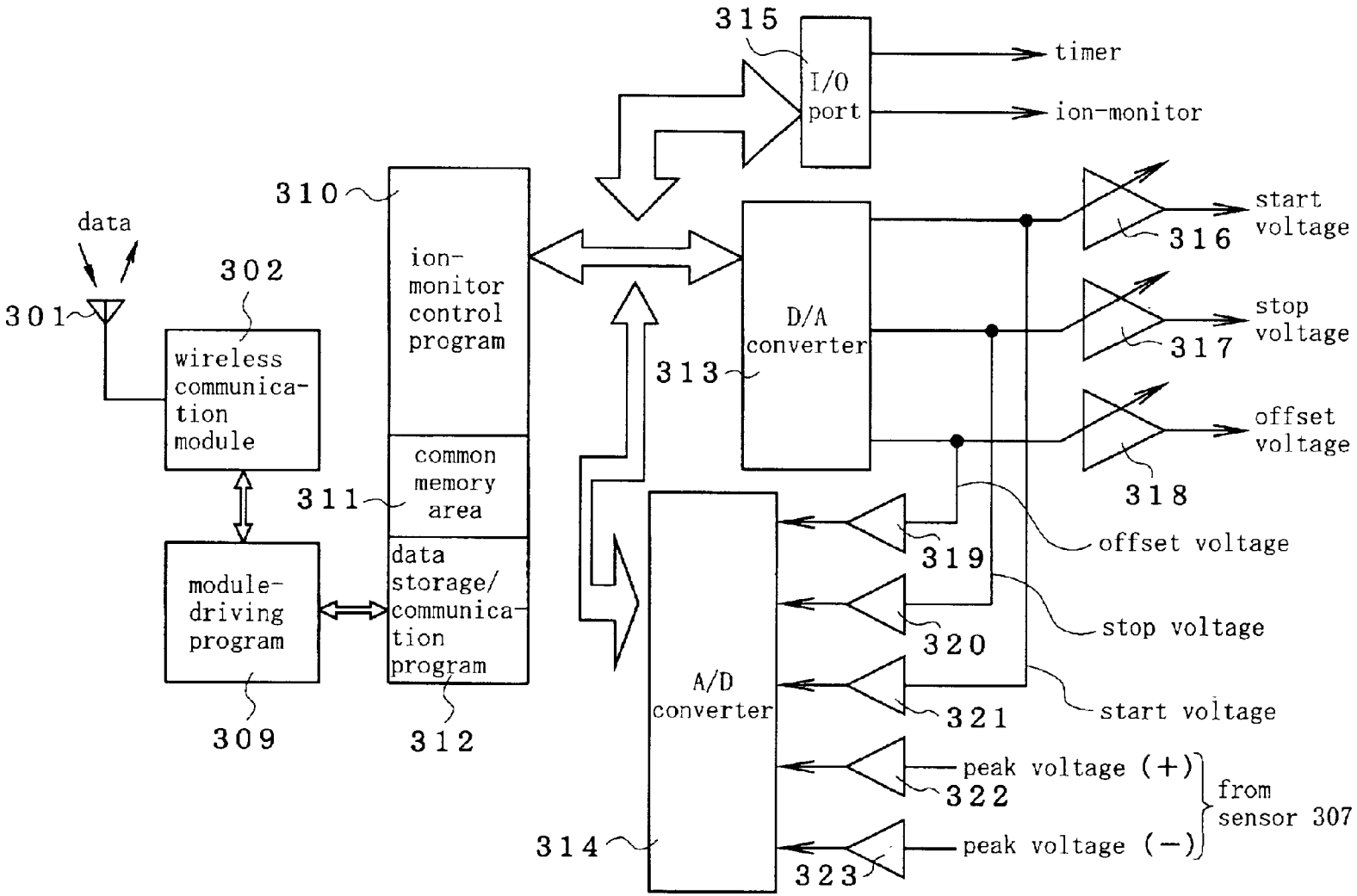
FIG. 5 is a block diagram showing a major portion of the configuration shown in FIG. 4.

FIG. 5 is a block diagram showing a major portion in FIG. 4. The major portion thereof corresponds to the internal configurations of the wireless communication module 302 and the control unit 303 shown in FIG. 4.

In FIG. 5, the effects of a module-driving program 309 and a data storage/communication program 312 are similar to those of the module-driving program 208 and the data storage/communication program 211 shown in FIG. 3, respectively.

An ion-monitor control program 310 shown in FIG. 5 creates control data for the driver unit 304 to cause the charge plate 306 to become charged in accordance with the operational condition data received by the wireless communication module 302 from the server 100. The ion-monitor control program 310 is used to obtain the measured data, such as the voltage and the amount of ions of the charge plate, and to execute processing for transmitting the data to the server 100 via the wireless communication module 302 in conjunction with the operational state data of the corresponding ion monitor 300.

Additionally, the ion monitor 300 has functions of activating a timer via an I/O port 315 during the measurement of static-decay time, and of turning the power supply on and off when the server 100 selects the corresponding ion monitor 300 from among a plurality of ion monitors. The ion-monitor control program 310 also executes the processing therefor.

The control data, created by the ion-monitor control program 310, for the driver unit 304 includes the above-mentioned start voltage, stop voltage, and offset voltage. The data is sent to the driver unit 304 via a D/A converter 313 and amplifiers 316 to 318.

The data to be input to the amplifiers 316 to 318 is also input to an A/D converter 314 via amplifiers 319 to 321. In addition, the peak value of the voltage, detected by the sensor 307, of the charge plate 306 is input as measured data to the A/D converter 314 via amplifiers 322 and 323.

The A/D converter 314 outputs digital data, and the ion-monitor control program 310 receives and processes the digital data to create measured data and operational state data indicating the operational state of the corresponding ion monitor 300.

The measured data and the operational state data are transmitted to the server 100 via the wireless communication module 302, and the server 100, in turn, executes the above-described control processing for the ionizer 200 and display processing, which is described below.

Figure 6:
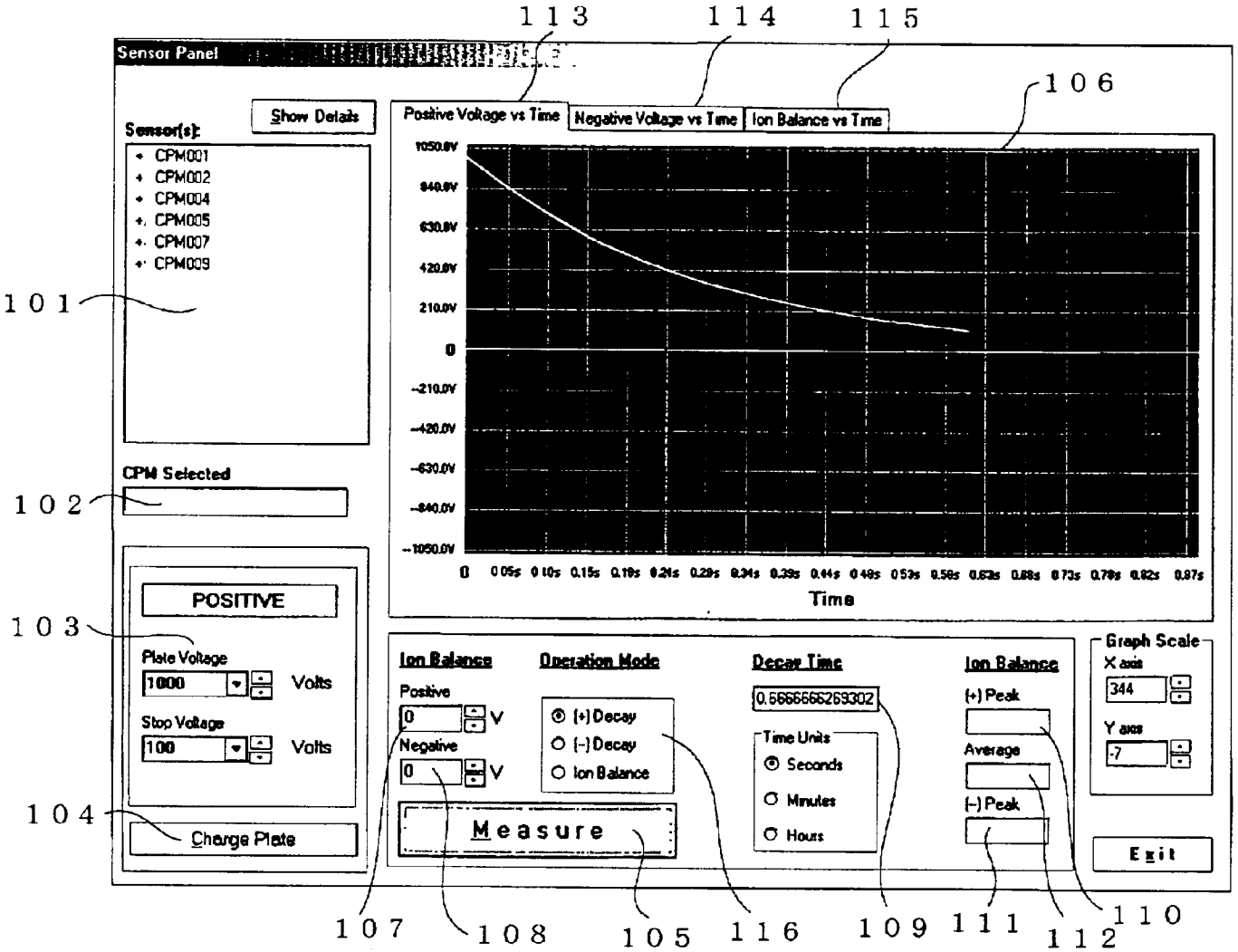
FIG. 6 is a view showing an example of a measurement screen displayed on the display of a server.

FIG. 6 is a view showing one example of a measurement screen displayed on the display of the server 100.

In FIG. 6, reference numeral 101 indicates an ion-monitor display area in which a plurality of ion monitors included in the entire system are displayed as identification codes, and in this example, six charge-plate monitors are displayed as CPM001, CPM002, . . . , and CPM009. When one of the charge-plate monitors is selected for use in evaluation of the performance of an ionizer, the corresponding identification code is displayed in an ion-monitor selection area 102.

Reference numeral 103 indicates a voltage setting area for setting a start voltage for causing the charge plate of a selected charge-plate monitor to become charged and a stop voltage. For example, when the charge plate is to be positively charged, the start voltage is set to +1,000 V and the stop voltage is set to +100 V.

Reference numeral 104 indicates a charge start button. Clicking the button 104 causes a control signal to be transmitted from the server 100 to a selected charge-plate monitor, thereby causing the power supply to be turned on and causing the charge plate to become charged with a set start voltage. These operations are executed via the ion-monitor control program 310, the I/O port 315, and the like which are shown in FIG. 5

In this case, suppose the ionizer 200 whose performance is to be evaluated by the charge-plate monitor is already activated in accordance with the command from the server 100, and, for example, positive ions have already been blown along the charge plate.

Reference numerals 107 and 108 shown in FIG. 6 are alarm-setting areas, which are used for setting thresholds for causing an alarm to be generated when the ions are out of balance in the positive or negative direction. These thresholds are user-definable, such that, when the voltage of the charge plate exceeds the set thresholds, an alarm is generated.

Next, clicking a measurement start button 105 causes the activation of a timer for measuring static-decay time, thereby initiating the measurement of required time when static electricity is removed from the charge plate from the start voltage to the stop voltage. Reference numeral 116 indicates an operation-mode selection area 116, and a static-decay-time measurement mode during charging with a positive voltage is shown in FIG. 6.

Reference numeral 109 indicates a static-decay-time display area. Specifically, the server 100 receives measured data (i.e., a voltage input to the A/D converter 314 via the amplifier 322 or 323 shown in FIG. 5) from the charge-plate monitor, determines time when the voltage of the charge plate reaches the stop voltage, and displays the measured time as static-decay time in the static-decay-time display area 109.

The voltage of the charge plate is constantly displayed on a display section 106 of a positive-voltage display screen 113. Reference numeral 114 indicates a tab for displaying a negative-voltage display screen, and 115 indicates a tab for displaying an ion-balance display screen.

Additionally, reference numerals 110 and 111 indicate positive/negative ion-balance display areas. Specifically, when there is an unbalanced positive or negative voltage during the measurement of ion balance, either of the ion-balance display areas 110 and 111 holds the peak value of the voltage and displays it. Reference numeral 112 indicates an average-value display area for displaying the average value of the unbalanced voltage.

While the description in this embodiment has been given of a case in which the measurement screen shown in FIG. 6 is displayed on the display of the server 100, such display functions and a display may be provided at the ion monitor 300 to perform display.

Other possible contents displayed on the screen of the server 100 include the operational states of each ionizer 200 and the ion monitor 300. For example, if the voltage of the charge plate does not vary even when the ion monitor 300 is in a normal operation state, then the server 100 may display the identification code of the corresponding ionizer 200 with an assumption that the ionizer 200 is out of order. In addition, if the ion monitor 300 does not measure a charge start voltage transmitted, as ion-monitor control data, from the server 100, then the server 100 can also display the operational state (abnormal condition), i.e. display the identification data of the corresponding ion monitor 300 with an assumption that the ion monitor 300 is out of order.

Figure 7:
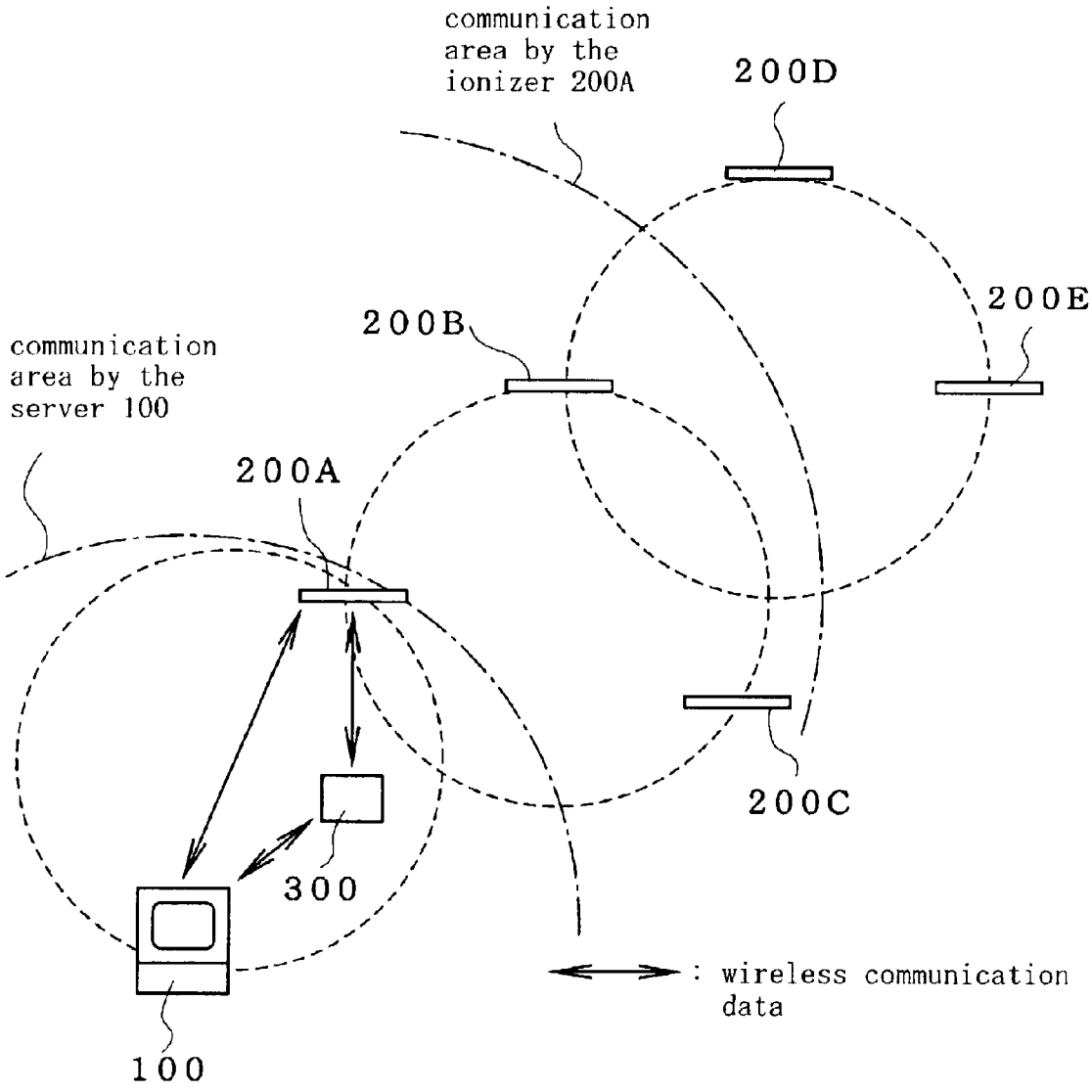
FIG. 7 is a schematic diagram showing the positional relationship among the server, ionizers, and ion monitor.

Next, FIG. 7 is a schematic diagram showing the positional relationship of the server 100, ionizers 200A to 200E, and the ion monitor 300.

In FIG. 7, for a short-distance wireless communication of data between the server 100, the ionizer 200A, and the ion monitor 300, the maximum distance therebetween is about 10 meters, and thus, for example, the server 100 and the other ionizers 200B, 200C, or the like cannot directly communicate with each other.

The ionizer control data transmitted from the server 100 to the ionizer 200A may include data for setting the ionizer 200A as a master and, for example, 200B and 200C as slaves, and may further include ionizer control data for the ionizer 200B and 200C that are set as the slaves. With this arrangement, in accordance with the ionizer control data received from the server 100, the ionizer 200A serving as the master transmits, using the configuration in FIG. 3, corresponding ionizer control data for the ionizers 200B and 200C serving as the slaves. This makes it possible to control the magnitude and time of a positive or negative voltage to be applied to the emitters of the ionizers 200B and 200C.

Similarly, the server 100 can collect the operational state data of the ionizers 200B and 200C as well via the ionizer 200A in conjunction with the operational state data of the ionizer 200A.

The above principle is also applicable to a case in which data is transmitted to or received from a plurality of ion monitors 300.

Thus, according to the present invention, the server 100 can individually control a great number of ionizers 200 and ion monitors 300 which are scattered in a wide area and, in theory, up to an infinite distance, i.e., without being subjected to the limitation of the communication distance of a short-distance wireless communication standard, such as Bluetooth (registered trademark).

Additionally, a plurality of ionizers having the same operating condition, such as the magnitude and time of a voltage applied to the emitters, may be processed as one group, such that they can be controlled collectively. In such a case, for example, the ion monitor measures and evaluates the performance of one of the ionizers in the group and transmits the resulting data to the server, and the server creates one type of ionizer control data for adjusting the ion balance and transmits the ionizer control data to all the ionizers in the group.

What is claimed is:

1. An ionizer control system, comprising:

an ionizer for removing static electricity from an object by generating positive and negative ions through corona discharging;

an ion monitor for evaluating the performance of the ionizer; and a server for managing and controlling the ionizer and the ion monitor, wherein the ionizer, the ion monitor, and the server each include wireless communication means that complies with a short-distance wireless communication standard, the server and the ionizer transmit and receive ionizer control data therebetween via the wireless communication means, and the server and the ion monitor transmit and receive ion-monitor control data therebetween via the wireless communication means.

2. An ionizer control system according to claim 1, wherein the ionizer control data includes data for controlling the magnitude and the time of a positive or negative voltage applied to an emitter of the ionizer.

3. An ionizer control system according to claim 1 or 2, wherein, when the ion monitor is a charge-plate monitor, the ion-monitor control data includes a charge start voltage and a charge stop voltage.

4. An ionizer control system according to claim 1 or 2, wherein the ion monitor transmits measured data to the server via the wireless communication means, and the server creates the ionizer control data in accordance with the measured data, transmits the ionizer control data to the ionizer via the wireless communication means, and displays the measured data on a display.

5. An ionizer control system according to claim 3, wherein the ion monitor transmits measured data to the server via the wireless communication means, and the server creates the control data for the ionizer in accordance with the measured data, transmits the control data to the ionizer via the wireless communication means, and displays the measured data on a display.

6. An ionizer control system according to claim 1 or 2, wherein the ionizer and the ion monitor each transmit operational state data indicating its own operational state to the server via the wireless communication means, and the server displays the operational state data on a display.

7. An ionizer control system according to claim 3, wherein the ionizer and the ion monitor each transmit operational state data indicating its own operational state to the server via the wireless communication means, and the server displays the operational state data on a display.

8. An ionizer control system according to claim 4, wherein the ionizer and the ion monitor each transmit operational state data indicating its own operational state to the server via the wireless communication means, and the server displays the operational state data on a display.

9. An ionizer control system according to claim 5, wherein the ionizer and the ion monitor each transmit operational state data indicating its own operational state to the server via the wireless communication means, and the server displays the operational state data on a display.

10. An ionizer control system according to claim 1 or 2, wherein the ionizer comprises a plurality of the ionizers, and of the plurality of ionizers, one ionizer capable of directly communicating with the server via the wireless communication means is set as a master and the other ionizers are set as slaves, and the ionizer control data for the slaves and the operational state data of the slaves are transmitted to and received from the server via the master.

11. An ionizer control system according to claim 3, wherein the ionizer comprises a plurality of the ionizers, and of the plurality of ionizers, one ionizer capable of directly communicating with the server via the wireless communication means is set as a master and the other ionizers are set as slaves, and the ionizer control data for the slaves and the operational state data of the slaves are transmitted to and received from the server via the master.

12. An ionizer control system according to claim 4, wherein the ionizer comprises a plurality of the ionizers, and of the plurality of ionizers, one ionizer capable of directly communicating with the server via the wireless communication means is set as a master and the other ionizers are set as slaves, and the ionizer control data for the slaves and the operational state data of the slaves are transmitted to and received from the server via the master.

13. An ionizer control system according to claim 5, wherein the ionizer comprises a plurality of the ionizers, and of the plurality of ionizers, one ionizer capable of directly communicating with the server via the wireless communication means is set as a master and the other ionizers are set as slaves, and the ionizer control data for the slaves and the operational state data of the slaves are transmitted to and received from the server via the master.

14. An ionizer control system according to claim 6, wherein the ionizer comprises a plurality of the ionizers, and of the plurality of ionizers, one ionizer capable of directly communicating with the server via the wireless communication means is set as a master and the other ionizers are set as slaves, and the ionizer control data for the slaves and the operational state data of the slaves are transmitted to and received from the server via the master.

15. An ionizer control system according to claim 7, wherein the ionizer comprises a plurality of the ionizers, and of the plurality of ionizers, one ionizer capable of directly communicating with the server via the wireless communication means is set as a master and the other ionizers are set as slaves, and the ionizer control data for the slaves and the operational state data of the slaves are transmitted to and received from the server via the master.

16. An ionizer control system according to claim 8, wherein the ionizer comprises a plurality of the ionizers, and of the plurality of ionizers, one ionizer capable of directly communicating with the server via the wireless communication means is set as a master and the other ionizers are set as slaves, and the ionizer control data for the slaves and the operational state data of the slaves are transmitted to and received from the server via the master.

17. An ionizer control system according to claim 9, wherein the ionizer comprises a plurality of the ionizers, and of the plurality of ionizers, one ionizer capable of directly communicating with the server via the wireless communication means is set as a master and the other ionizers are set as slaves, and the ionizer control data for the slaves and the operational state data of the slaves are transmitted to and received from the server via the master.

18. An ionizer control system, comprising:

an ionizer for removing static electricity from an object by generating positive and negative ions through corona discharging; and an ion monitor for evaluating the performance of the ionizer and managing and controlling the ionizer, wherein the ionizer and the ion monitor each include wireless communication means that complies with a short-distance wireless communication standard, the ion monitor and the server transmit and receive ionizer control data, including data for controlling the magnitude and the time of a positive or negative voltage applied to an emitter of the ionizer, therebetween via the wireless communication means.

19. An ionizer control system according to claim 18, wherein the ionizer transmits operational state data indicating its own operational state to the ion monitor via the wireless communication means, and the ion monitor displays measured data and the operational state data on a display.

* * * * *